US009663911B2

(12) United States Patent
Cmich et al.

(10) Patent No.: US 9,663,911 B2
(45) **Date of Patent: *May 30, 2017**

(54) SNOW THROWER

(71) Applicant: MTD PRODUCTS INC, Valley City, OH (US)

(72) Inventors: Ryan Cmich, Sharon Township, OH (US); Tim Dilgard, Ashland, OH (US); Jimmy N. Eavenson, Sr., Aurora, OH (US); Dave Hein, Elyria, OH (US); Joe Jocke, Grafton Townshiop, OH (US); Amit Saha, Hudson, OH (US)

(73) Assignee: MTD PRODUCTS INC, Valley City, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/168,749

(22) Filed: May 31, 2016

(65) Prior Publication Data

US 2016/0273178 A1 Sep. 22, 2016

Related U.S. Application Data

(63) Continuation of application No. 14/467,464, filed on Aug. 25, 2014, now Pat. No. 9,365,989, which is a (Continued)

(51) Int. Cl.
*E01H 5/09* (2006.01)
*E01H 5/04* (2006.01)

(52) U.S. Cl.
CPC ..... *E01H 5/098* (2013.01); *E01H 5/045* (2013.01); *E01H 5/09* (2013.01); *E01H 5/096* (2013.01)

(58) Field of Classification Search
CPC E01H 5/045; E01H 5/09; E01H 5/096; E01H 5/098
See application file for complete search history.

(56) References Cited

U.S. PATENT DOCUMENTS 1,770,587 A 7/1930 Carpenter
2,219,204 A 10/1940 Wandscheer
(Continued)

FOREIGN PATENT DOCUMENTS

AT 269942 B 4/1969
AT 385300 3/1988
(Continued)

OTHER PUBLICATIONS

International Search Report and Written Opinion dated Aug. 14, 2013 for corresponding Application No. PCT/US2013/026427.
(Continued)

*Primary Examiner* — Jamie L McGowan
(74) *Attorney, Agent, or Firm* — Wegman, Hessler & Vanderburg

(57) ABSTRACT

A three-stage snow thrower having a housing, a power supply operatively connected to said housing, a longitudinal drive shaft extending from the power supply into the housing, and a lateral drive shaft extending rotatably attached to opposing side walls of the housing and being meshingly engaged with the longitudinal drive shaft within a gear assembly. The power supply drives the longitudinal drive shaft, thereby causing the longitudinal drive shaft to rotate, and at least a portion of such rotation is transferred to the lateral drive via a gear assembly. The first stage assembly includes a plurality of augers attached to the lateral drive shaft, wherein the first stage assembly pushes loosened snow axially toward the gear assembly. The second stage assembly includes at least one auger attached to the longitudinal drive shaft, wherein the second stage assembly pushes the snow from the first stage assembly axially rearward in a transverse manner relative to the first stage assembly. The third stage assembly includes an impeller that rotates to throw the snow from the second stage assembly through a
(Continued)

chute attached to the housing to expel the snow from the housing.

21 Claims, 4 Drawing Sheets

Related U.S. Application Data continuation of application No. 13/465,625, filed on May 7, 2012, now Pat. No. 8,844,172.

(60) Provisional application No. 61/605,986, filed on Apr. 12, 2012.

(56) References Cited

U.S. PATENT DOCUMENTS

| | | | | | |
|---|---|---|---|---|---|
| 3,143,815 | A | | 8/1964 | Harvey | |
| 3,805,421 | A | * | 4/1974 | Kamlukin | E01H 5/045 37/233 |
| 3,913,247 | A | * | 10/1975 | Ruhl | E01H 5/098 198/513 |
| 4,123,857 | A | | 11/1978 | Enters et al. | |
| 4,188,738 | A | | 2/1980 | Vohl | |
| 4,203,237 | A | | 5/1980 | Enters et al. | |
| 4,255,880 | A | | 3/1981 | McMickle et al. | |
| 4,261,116 | A | * | 4/1981 | Kahlbacher | E01H 5/096 37/248 |
| 4,288,933 | A | | 9/1981 | Fair | |
| 4,300,295 | A | | 11/1981 | Heismann | |
| 4,325,195 | A | | 4/1982 | Comer | |
| 4,346,526 | A | | 8/1982 | Mattson et al. | |
| 4,346,527 | A | | 8/1982 | Schmidt | |
| 4,360,983 | A | | 11/1982 | Krug | |
| 4,457,086 | A | | 7/1984 | Bacon | |
| 4,477,989 | A | * | 10/1984 | Vachon | E01H 5/098 299/39.8 |
| 4,498,253 | A | | 2/1985 | Schmidt | |
| 4,541,187 | A | | 9/1985 | Phelps | |
| 4,597,203 | A | | 7/1986 | Middleton | |
| 4,619,061 | A | | 10/1986 | Swanson | |
| 4,679,338 | A | | 7/1987 | Middleton | |
| 4,680,881 | A | | 7/1987 | Cloutier | |
| 4,694,594 | A | | 9/1987 | Thorud et al. | |
| 4,761,901 | A | | 8/1988 | Szafarz | |
| 4,765,073 | A | | 8/1988 | Cloutier | |
| 4,869,003 | A | | 9/1989 | O'Loughlin | |
| 4,899,471 | A | | 2/1990 | Sasaki et al. | |
| 4,951,403 | A | | 8/1990 | Olmr | |
| 5,000,302 | A | | 3/1991 | Takeshita | |
| RE33,726 | E | | 10/1991 | Thorud et al. | |
| 5,101,585 | A | | 4/1992 | Gerbrandt | |
| 5,123,186 | A | | 6/1992 | Matushita et al. | |
| 5,127,174 | A | | 7/1992 | Takeshita | |
| 5,174,053 | A | | 12/1992 | Takeshita | |
| 5,398,432 | A | * | 3/1995 | Vohl | E01H 5/098 37/213 |
| 5,450,910 | A | | 9/1995 | Strzyzewski | |
| 5,813,152 | A | | 9/1998 | Weight | |
| 6,131,316 | A | | 10/2000 | Yoshina et al. | |
| 6,199,306 | B1 | | 3/2001 | Kauppila et al. | |
| 6,260,293 | B1 | | 7/2001 | Monroe | |
| 6,318,003 | B1 | | 11/2001 | Heismann | |
| 6,353,212 | B1 | | 3/2002 | Smith | |
| 6,470,602 | B2 | | 10/2002 | White, III et al. | |
| 6,470,766 | B2 | | 10/2002 | Ohta et al. | |
| 6,539,649 | B2 | | 4/2003 | Sueshige et al. | |
| 6,560,905 | B2 | | 5/2003 | Monroe | |
| 6,865,826 | B1 | | 3/2005 | Lakin | |
| 6,938,364 | B2 | | 9/2005 | White, III et al. | |
| 7,305,777 | B2 | * | 12/2007 | Kettering | E01H 5/098 37/213 |
| D705,271 | S | * | 5/2014 | Cmich | D15/11 |
| D705,272 | S | * | 5/2014 | Cmich | D15/11 |
| D705,820 | S | * | 5/2014 | Cmich | D15/11 |
| 8,844,172 | B2 | * | 9/2014 | Cmich | E01H 5/045 37/248 |
| 9,365,989 | B2 | * | 6/2016 | Cmich | E01H 5/045 |
| 2004/0255492 | A1 | | 12/2004 | White et al. | |

FOREIGN PATENT DOCUMENTS

| | | | | |
|---|---|---|---|---|
| AT | 385300 B | * | 3/1988 | E01H 5/076 |
| CN | 2134422 | | 5/1993 | |
| CN | 2846489 | | 12/2006 | |
| CN | 101487241 | | 7/2009 | |
| CN | 201280706 | | 7/2009 | |
| DE | 35 18 442 | | 1/1986 | |
| DE | 10 2004 003111 | | 8/2004 | |
| JP | 59-31616 | | 2/1984 | |
| JP | 63-061427 | | 4/1988 | |
| JP | H04 1314 | | 1/1992 | |
| JP | 2004360379 | | 12/2004 | |
| KR | 10-2001-0090711 | | 10/2001 | |

OTHER PUBLICATIONS

Office Action for corresponding Chinese Patent Application No. 201380024840.5 dated Sep. 6, 2015.

Airport Technologies Inc., "Snow Wolf" flyer; published prior to Mar. 2, 2011.

Russian Office Action dated Feb. 19, 2016 for corresponding Russian Patent Application No. 2014143906 filed Feb. 15, 2013.

First Office Action for Japanese Patent Application No. 2015-505711 dated Oct. 11, 2016.

Notice of Preliminary Rejection for Korean Patent Application No. 10-2014-7031646 dated Oct. 4, 2016.

EP Communication pursuant to Rule 164(2)(b) and Article 94(3) EPC for corresponding European patent application No. 13 707 968.7 dated Aug. 8, 2016.

* cited by examiner

SNOW THROWER

CROSS-REFERENCE TO RELATED APPLICATIONS

The present application is a continuation application and claims the benefit of Ser. No. 14/467,464 filed on Aug. 25, 2014, which is a continuation of U.S. patent application Ser. No. 13/465,625 filed on May 7, 2012, which claims priority to U.S. Provisional Patent Application Ser. No. 61/605,986, filed Apr. 12, 2012.

FIELD OF THE INVENTION

The present invention is directed to snow removal devices, and more particularly, to a snow thrower having three distinct stages of transferring loosened snow.

BACKGROUND OF THE INVENTION

Snow removal machines typically include housings with a forward opening through which material enters the machine. At least one rotatable member (auger) is positioned and rotatably secured within the housing for engaging and eliminating the snow from within the housing. Snow blower technology is generally focused on designs whereby flighted augers move snow axially toward an impeller that is driven integrally (single stage) or independently driven (two-stage). Impellers are usually devices such as discs and blades that are shaped and configured such that when rotated they receive materials (snow) and then centrifugally discharge the materials through openings in the housings and then into chutes that control and direct the materials.

The known single stage and two-stage snow throwers have limitations in performance which often result from the augers typically moving material axially and impellers centrifugally, wherein the transition volume between the augers and impellers requires a tertiary force such as forward propulsion of the housing toward the materials to push the material into the impeller(s). Two-stage impellers separate the drive means of the augers and impellers so that each can operate at slower or higher speeds that improve their effectiveness, but in so doing, a transition volume is created. A need therefore exists for a snow thrower that reduces or eliminates the necessity of forward propulsion by the operator that also increases the operational efficiency of the snow thrower.

BRIEF SUMMARY OF THE INVENTION

According to one aspect of the present invention, a three-stage snow thrower is provided. The three-stage snow thrower includes a power supply and a housing operatively connected to the power supply. A longitudinal drive shaft is operatively connected to the power supply and at least a portion of the longitudinal drive shaft is positioned within the housing, wherein the power supply selectively rotates the longitudinal drive shaft. A lateral drive shaft is operatively connected to the longitudinal drive shaft, wherein the lateral drive shaft is oriented transverse relative to the longitudinal drive shaft. Rotation of the longitudinal drive shaft causes rotation of the lateral drive shaft. The three stage snow thrower includes a first stage assembly operatively connected to the lateral drive shaft for moving snow axially relative to the lateral drive shaft. A second stage assembly is operatively connected to the longitudinal drive shaft for receiving the snow from the first stage assembly and moving the snow axially relative to the longitudinal drive shaft. A third stage assembly is operatively connected to the longitudinal drive shaft adjacent to the second stage assembly for receiving the snow from the second stage assembly and moving the snow radially into a chute attached to the housing to discharge the snow from the housing.

According to another aspect of the present invention, a three-stage snow thrower is provided. The three-stage snow thrower includes a housing, wherein a chute extends from the housing, and snow is expellable from the housing through the chute. A power supply is operatively connected to the housing. A first stage assembly is positioned within the housing, wherein the first stage assembly moves the snow in a lateral direction within the housing. A second stage assembly is at least partially positioned within the housing, wherein the second stage assembly moves the snow longitudinally within the housing in a direction transverse to the lateral direction. A third stage assembly is positioned within the housing, wherein the third stage assembly moves the snow radially to said chute to be expelled from the housing. The power supply is operatively connected to the first, second, and third stage assemblies for providing rotational power to each of the stage assemblies.

According to yet another aspect of the present invention, a three-stage snow thrower is provided. The three-stage snow thrower includes a housing, wherein a chute extends from the housing, and snow is expellable from the housing through the chute. A power supply is operatively connected to the housing. A longitudinal drive shaft is rotatably driven by the power supply, at least a portion of the longitudinal drive shaft extends between the power supply and a casing of a gear assembly. A lateral drive shaft is rotatably attached to opposing side walls of the housing. The lateral drive shaft is meshingly engaged with the longitudinal drive shaft within the casing of the gear assembly, wherein rotation of the longitudinal drive shaft causes rotation of the lateral drive shaft through the meshing engagement therebetween. A first stage assembly operatively connected to the lateral drive shaft, wherein rotation of said lateral drive shaft causes said first stage assembly to move said snow within said housing toward said gear assembly. A second stage assembly operatively connected to the longitudinal drive shaft, wherein rotation of the longitudinal drive shaft causes the second stage assembly to move the snow near the gear assembly toward the power supply. A third stage assembly is operatively connected to the longitudinal drive shaft, wherein rotation of the longitudinal drive shaft causes the third stage assembly to move the snow from the second stage assembly toward the chute for expelling the snow from the housing.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1:
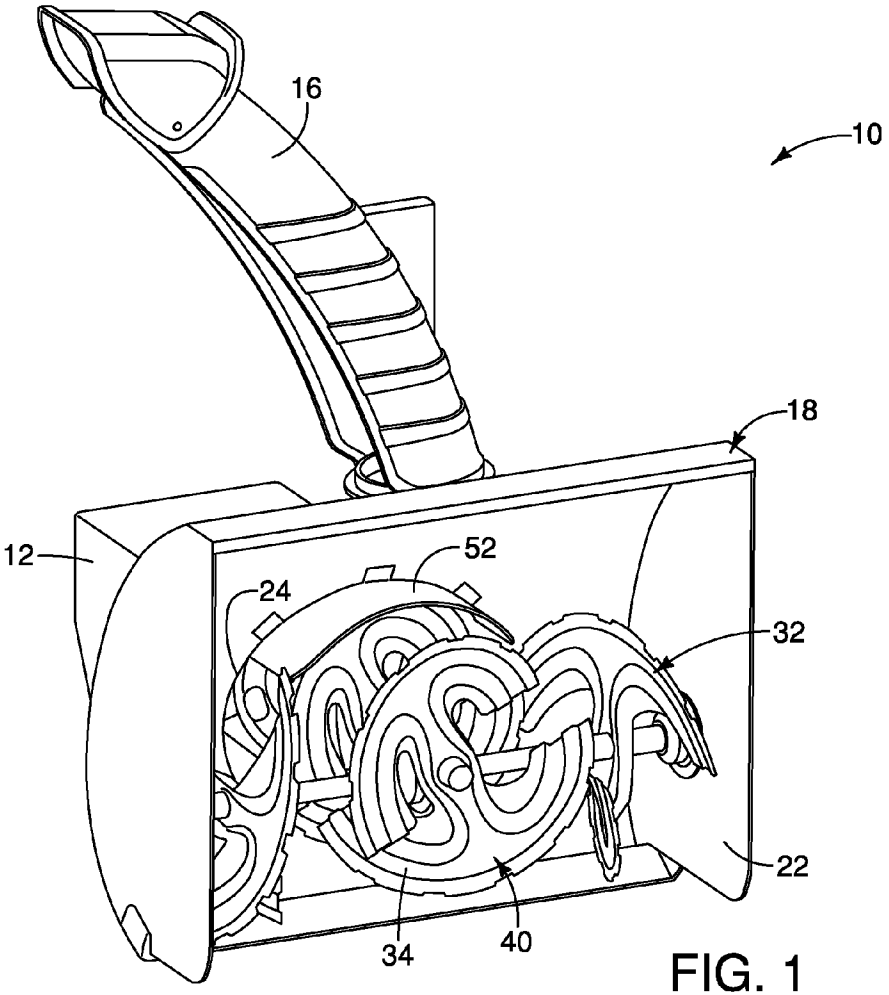
FIG. 1 is top perspective view of a portion of a three-stage snow thrower.
Figure 3:
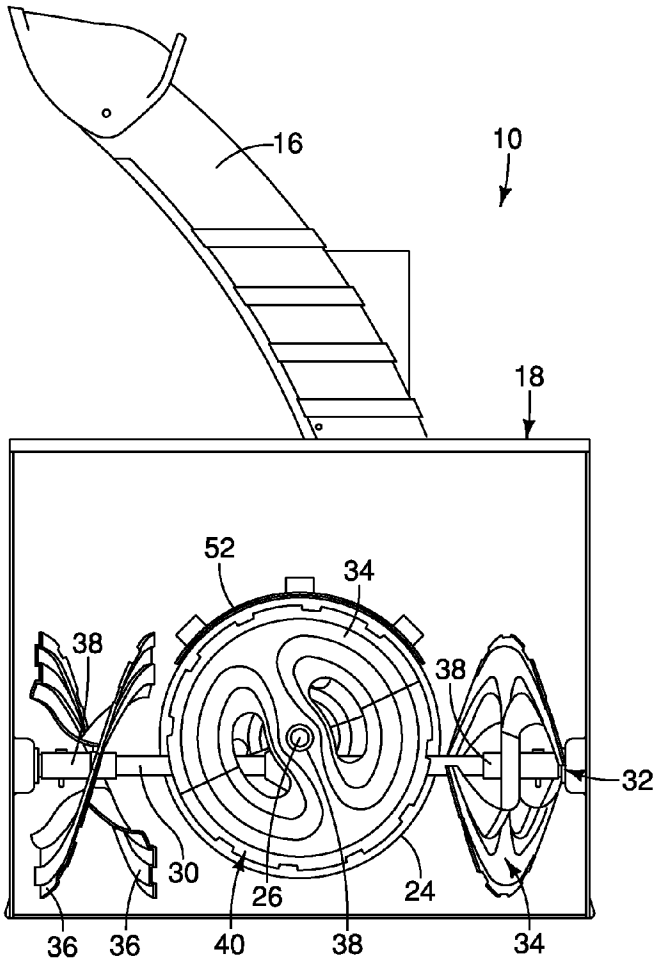
FIG. 3 is a front view of the snow thrower shown in FIG. 1.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Referring to FIG. 1, an exemplary embodiment of a three-stage snow thrower 10 is shown. In the illustrated embodiment, the snow thrower 10 includes a power supply 12 configured to provide power for driving the three stages used to remove or throw accumulated snow from concrete, pavement, or the like. It should be understood by one of ordinary skill in the art that the snow thrower 10 may alternatively include a cord to receive electrical power, an internal combustion engine, a rechargeable battery, or any other commonly known power supplies. The snow thrower 10 also includes a pair of graspable handles (not shown) attached to the power supply that can be used by an operator to control the direction and movement of the snow thrower 10. The snow thrower 10 also includes tracks or a pair of wheels (not shown) attached to the power supply for allowing the snow thrower to roll along the ground while removing accumulated snow. The snow thrower 10 is configured to remove piled-up snow and propels, or throws the snow to a different location from a chute 16 that is operatively connected to a housing 18 into which the piled-up snow enters the snow thrower 10.

The housing 18 is a generally semi-cylindrical, or C-shaped casing including a recess 20 extending rearwardly from the central C-shaped portion, wherein the housing 18 is longitudinally oriented in a transverse direction relative to the forward direction of movement of the snow thrower 10, as shown in FIGS. 1-4. In an embodiment, the housing 18 and recess 20 are formed of a metal material having a thickness sufficient to withstand lower temperatures as well as the repeated impact of snow and debris that is being removed from a sidewalk, driveway, parking lot, or the like. The housing 18 includes an opening 22 into which snow enters the housing 18 and an outlet aperture 24 though which the snow is forced to exit the housing 18 into the recess 20.

In the embodiment illustrated in FIGS. 1-4, the power supply 12 includes a longitudinal drive shaft 26 that extends from the power supply 12 into the housing 18 for providing rotational power to each of the three stages of the snow thrower 10. The power supply 12 selectively drives or rotates the longitudinal drive shaft 26, wherein the power supply 12 can cause the longitudinal drive shaft 26 to always rotate when the power supply 12 is in an on mode, the operator can selectively determine when the power supply 12 engages or causes the longitudinal drive shaft 26 to rotate, or the longitudinal drive shaft 26 does not rotate when the power supply 12 is in an off mode. One distal end of the longitudinal drive shaft 26 is connected to the power supply 12 and the opposing end of the longitudinal drive shaft 26 is operatively connected to a gear assembly 28 that is positioned within the housing 18. In an embodiment, the longitudinal drive shaft 26 extends to the gear assembly 28 such that the distal end of the longitudinal drive shaft 26 is disposed within the gear assembly 28. In another embodiment, one distal end of the longitudinal drive shaft 26 is connected to the power supply 12 and the longitudinal drive shaft 26 extends through the gear assembly 28 such that the opposing distal end of the longitudinal drive shaft 26 extends axially beyond the gear assembly 28. The longitudinal drive shaft 26 is aligned such that the longitudinal axis thereof is substantially aligned with the fore/aft direction of the three-stage snow thrower 10. In an embodiment, the longitudinal drive shaft 26 includes a worm gear 54 (FIGS. 5A-5B) formed on a portion the outer surface thereof that is positioned within the gear assembly 28 to cooperate with the gears (not shown) disposed therein.

As shown in FIGS. 1-4, a single lateral drive shaft 30 is rotatably attached to each of the opposing side walls of the housing 18, wherein a portion of the lateral drive shaft 30 is disposed within the casing of the gear assembly 28. The lateral drive shaft 30 is operatively connected to the gear assembly 28 in a substantially perpendicular or transverse manner relative to the longitudinal drive shaft 26. The gear assembly 28 includes a casing in which rotational power from the power supply 12 via the longitudinal drive shaft 26 generates or transfers rotational power to the lateral drive shaft 30. In an embodiment, the lateral drive shaft 30 includes a worm gear 54 (FIGS. 5A-5B) formed into the outer surface thereof, similar to the worm gear 54 formed onto the outer surface of the longitudinal drive shaft 26. The longitudinal drive shaft 26 and the lateral drive shaft 30 are operatively connected to all three stages of the three-stage snow thrower 10, thereby providing rotational power to each of the stages so as to quickly and efficiently move, or throw, accumulated snow.

The first stage assembly 32 of the three-stage snow thrower 10 includes at least two augers 34, wherein at least one auger 34 is attached to each portion of the lateral drive shaft 30 extending from the gear assembly 28, as shown in FIGS. 1-4. In the illustrated exemplary embodiment, the first stage assembly 32 includes one (1) auger 34 positioned on each portion of the lateral drive shaft 30 extending from the gear assembly 28. It should be understood by one of ordinary skill in the art that although the illustrated embodiment of the first stage assembly 32 includes only two augers 34, the first stage assembly 32 can include any number of augers 34 positioned adjacent to each side of the gear assembly 28 on the lateral drive shaft 30. The augers 34 are removably connected to the longitudinal and lateral drive shafts 26, 30 by way of a connecting mechanism such as a nut-and-bolt, cotter pin, or the like. The augers 34 of the first stage assembly 32 are configured to move snow axially along the lateral drive shaft 30, wherein the augers 34 located on opposing portions of the lateral drive shaft 30 relative to the gear assembly 28 are configured to move snow in an opposing manner relative to the augers 34 on the opposing portion of the lateral drive shaft 30. As such, the augers 34 of the first stage assembly 32 are configured to move snow, ice and other material toward the center of the housing 18, or toward the gear assembly 28 that is positioned at or near the center of the housing 18.

Each auger 34 includes at least one flight 36 that extends radially outward from a base 38 as well as extending at least somewhat concentrically with the outer surface of the base 38. In the illustrated embodiment, the flights 36 include a base portion that extends radially from the base 38 in a generally linear manner, and an arc-shaped blade portion that expands from the end of the base portion in a generally semi-circular manner about the base 38. The blade portion of the flight 36 is also curved, or angled in a helical manner about the base 38. The blade portion of each flight 36 extends about the base 38 about one hundred eighty degrees (180) such that two flights 36 extending about the entire periphery of the base 38. In another embodiment, each auger 34 has a single flight 36 that extends helically about the entire periphery of the base 38 in a helical manner. In yet another embodiment, each auger 34 includes more than two flights 36 extending from the base 38 such that all of the flights 36 extend about at least the entire periphery of the base 38. The augers 34 can be formed of segmented or continuous flights 36, or the augers 34 may include brushes incorporated with the flights 36. It should be understood by one of ordinary skill in the art that the augers 34 are configured in a corkscrew or spiral shape or orientation relative to the drive shaft 26, 30 to which they are attached such that rotation of the augers 34 push snow along the axis of rotation of the respective drive shaft. For example, the augers 34 of the first stage assembly 32 are configure to rotate and push or transport the snow in the direction from the side walls of the housing 18 toward the centrally-located gear assembly 28, and in a similar manner, the second stage assembly 40 is configured to rotate and push or transport the snow in the rearward direction from near the gear assembly 28 toward the recess 20.

In an embodiment, the second stage assembly 40 includes at least one auger 34 operatively connected to the longitudinal drive shaft 26, as shown in FIGS. 1-4. As explained above, the longitudinal drive shaft 26 extends from the power supply 12 to the gear assembly 28, and in the illustrated embodiment, the longitudinal drive shaft 26 also extends through and from the opposing side of the gear assembly 28. In the illustrated exemplary embodiment, one auger 34 is operatively connected to the longitudinal drive shaft 26 on the portion of the drive shaft that extends beyond the gear assembly 28 and another auger 34 is operatively connected to the longitudinal drive shaft 26 between the gear assembly 28 and the power supply 12. In an embodiment, both augers 34 are positioned immediately adjacent to the gear assembly 28. It should be understood by one of ordinary skill in the art that although the illustrated embodiment of the second stage assembly 40 includes only two augers 34, the second stage assembly 40 can include any number of augers 34 positioned adjacent to the gear assembly 28 on each of the longitudinal drive shaft 26. The augers 34 of the second stage assembly 40 are oriented such that the augers 34 drive the snow toward the rear of the housing 18 and toward the third stage assembly 42 positioned within the recess 20.

Figure 2:
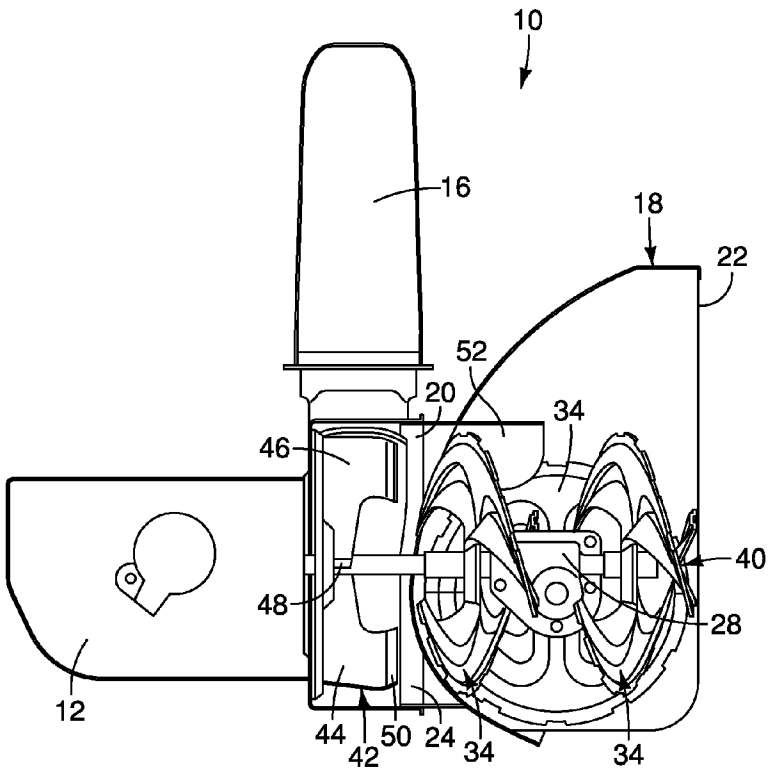
FIG. 2 is a side cross-sectional view of the snow thrower shown in FIG. 1.
Figure 4:
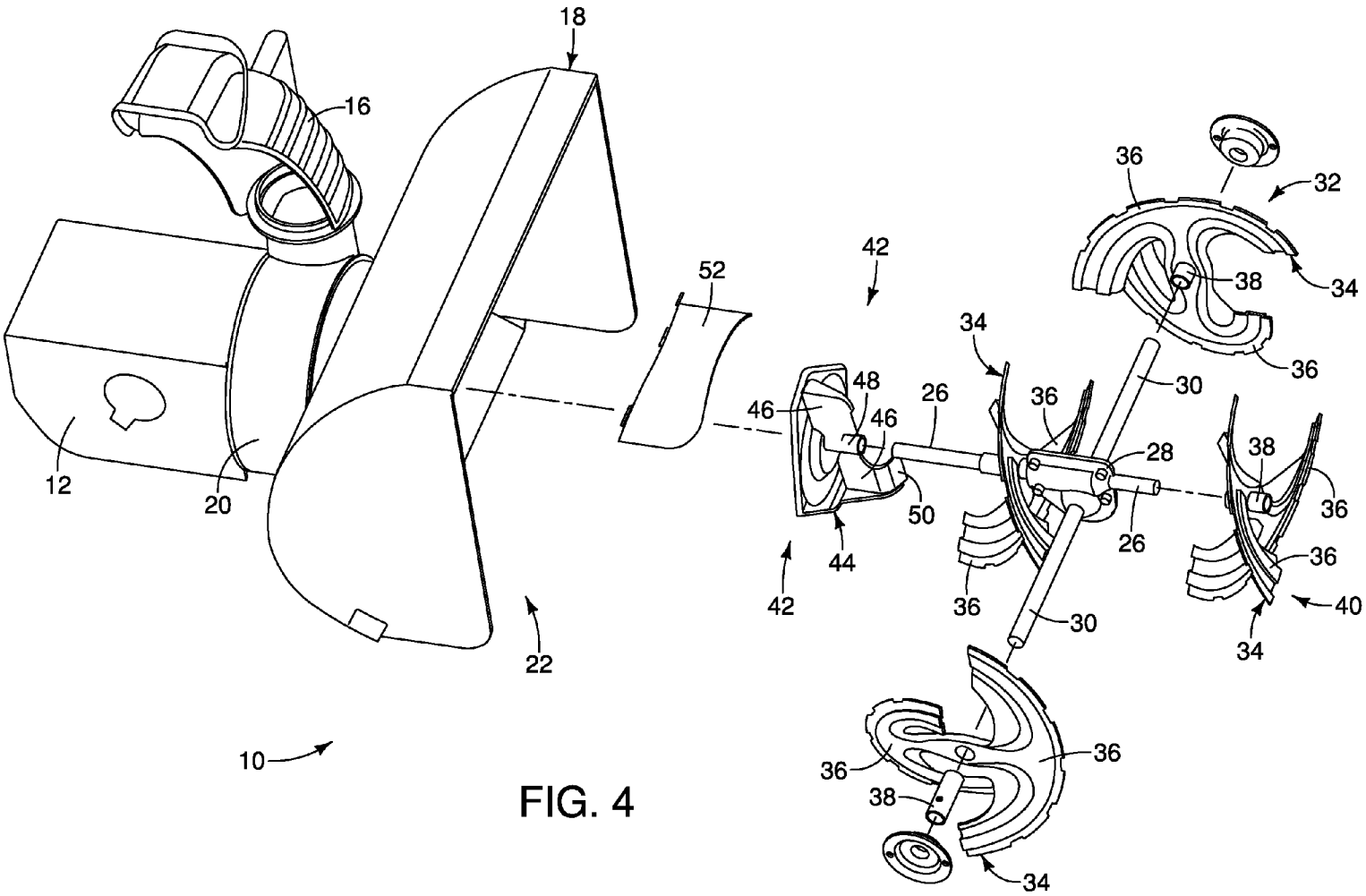
FIG. 4 is an exploded view of the snow thrower shown in FIG. 1.

In an embodiment, the third stage assembly 42 includes a rotatable impeller 44 operatively connected to the longitudinal drive shaft 26 and positioned within the recess 20, as shown in FIGS. 1-2 and 4. The impeller 44 is located on the longitudinal drive shaft 26 between the downstream-most auger 34 of the second stage assembly 40 and the power supply 12. The impeller 44 is configured to receive the snow from the second stage assembly 40, and through rotation of the impeller 44 about the longitudinal drive shaft 26 at a sufficient speed the snow is expelled or centrifugally thrown by the third stage assembly 42 through the chute 16 and away from the snow thrower 10. In an embodiment, the impeller 44 is removably attached to the longitudinal drive shaft 26 such that the impeller 44 can be removed and replaced. The impeller 44 can be attached to the longitudinal drive shaft 26 with any attachment mechanism such as nut-and-bolt, cotter pin, or the like.

As shown in FIGS. 2 and 4, an exemplary embodiment of an impeller 44 includes a plurality of blades 46 that extend radially outwardly from a base 38, wherein the impeller 44 is attached to the longitudinal drive shaft 26 by sliding the base 38 over the outer surface of the longitudinal drive shaft 26 and securing the impeller 44 to the drive shaft 34 by way of an attachment mechanism such as a nut-and-bolt, a cotter pin, or the like. In an embodiment, each blade 46 includes a tip 50 that extends from the end of the blade 46 in a curved manner. The tips 50 are curved in the direction of rotation of the impeller 44. The curved tips 50 assist in maintaining contact between the snow and the blades 46 as the impeller 44 rotates, thereby preventing the snow from sliding past the ends of the blades 46 to the gap between the blades 46 and the recess 20 before the snow is thrown into and from the chute 16. Preventing the snow from sliding past the end of the blades 46 results in less re-circulation of the snow within the recess 20, thereby making the snow thrower 10 more efficient in expelling the snow. Whereas the augers 34 are configured to push snow axially along the axis of rotation of the auger 34, the impeller 44 is configured to drive or throw snow in a radial direction away from the axis of rotation of the impeller 44. The impeller 44 and the auger 34 immediately adjacent thereto are oriented and timed such that they rotate at the same angular velocity, wherein as the snow slides from the end of the flight 36 of the auger 34 toward the impeller 44, the impeller 44 is positioned such that the snow enters the gap between adjacent blades 46 of the impeller 44 so that re-circulation of the snow is reduced.

In another embodiment, the impeller 44 and the augers 34 of the second stage assembly 40 positioned between the gear assembly 28 and the impeller 44 are attached to a hollow secondary shaft (not shown) that is hollow. This secondary shaft is positioned around the longitudinal drive axis 26 that extends between the power supply 12 and the gear assembly 28. This secondary shaft is configured to provide rotation power to the impeller 44 and the auger(s) 34 via the gear assembly 28. The longitudinal drive shaft 26 is driven by the power supply 12 and is rotatably connected to the gear assembly 28, wherein the rotational power is transferred from the longitudinal drive shaft 26 to the secondary shaft as well as the lateral drive shaft 30 by way of the gears in the gear assembly 28.

Figure 5A:
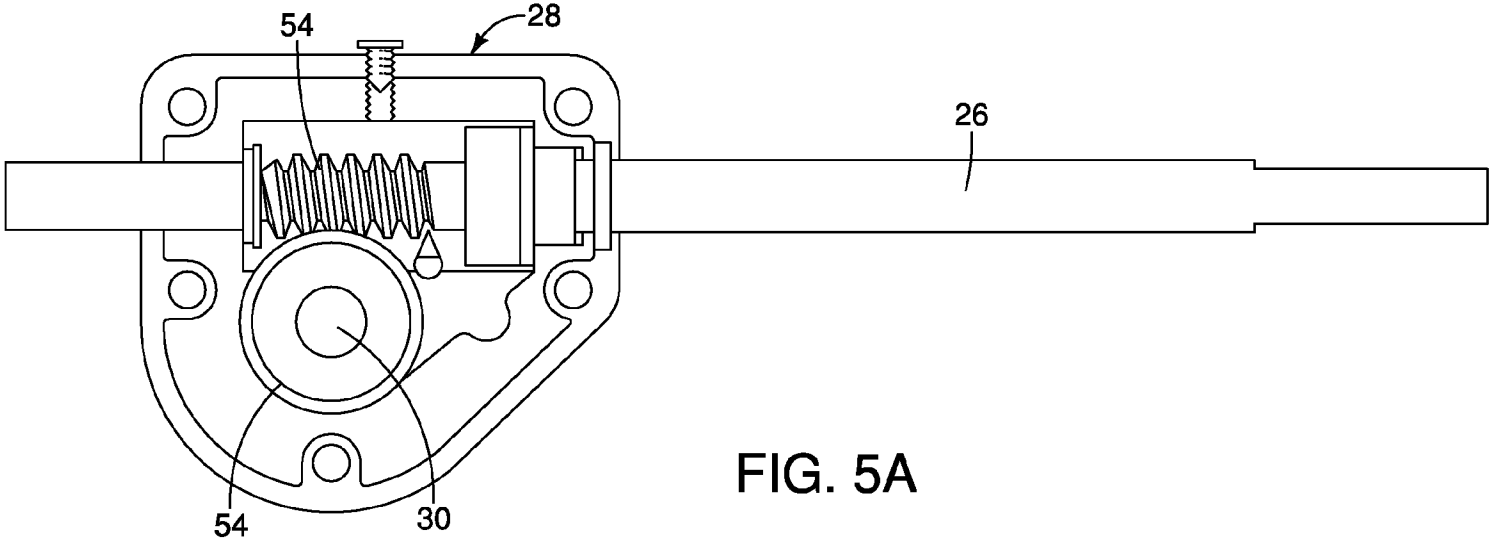
FIG. 5A is a side view of an embodiment of a gear assembly.
Figure 5B:
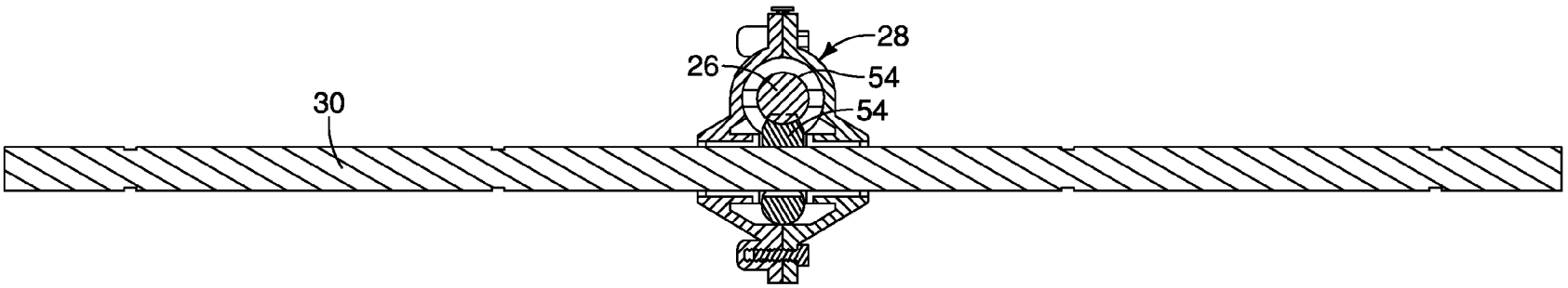
FIG. 5B is a front cross-sectional view of the gear assembly shown in FIG. 5A.

The gear assembly 28 is configured to transfer the rotational power from the power supply 12 via the longitudinal drive shaft 26 to the lateral drive shaft 30, as shown in FIGS. 5A-5B. In an embodiment, the worm gears 54 formed on the outer surfaces of both the longitudinal and lateral drive shafts 26, 30 are directly meshed within the gear assembly 28 such that the rotational power is directly transferred. Accordingly, both the longitudinal and lateral drive shafts 26, 30 rotate at substantially the same rotational velocity. In another embodiment, the gear assembly 28 includes at least one gear that operatively connects the longitudinal drive shaft 26 to the lateral drive shaft 30 to indirectly transfer rotational power from the longitudinal drive shaft 26 to the lateral drive shaft 30. In an embodiment, the gear assembly 28 includes a multiplier (not shown) operatively connecting the longitudinal and lateral drive shafts 26, 30, wherein the multiplier produces an increased rotational ratio such that the lateral drive shaft 30 rotates at an angular velocity that is greater than the rotational velocity of the longitudinal drive shaft 26. In another embodiment, the gear assembly 28 includes a reducer (not shown) operatively connecting the longitudinal and lateral drive shafts 26, 30, wherein the reducer produces an reduced rotational ratio such that the lateral drive shaft 30 rotates at an angular velocity that is less than the rotational velocity of the longitudinal drive shaft 26. It should be understood by one of ordinary skill in the art that any number of gears can be positioned between the longitudinal and lateral drive shafts 26, 30 to transfer rotational power therebetween.

In an embodiment, the snow thrower 10 also includes a baffle 52 positioned within and attached to the housing 18 such that it surrounds the opening to the recess 20, as shown in FIGS. 1-4. The baffle 52 is an arcuate, or curved member having a radius of curvature that is substantially the same as the radius of curvature of the opening to the recess 20. In an embodiment, the baffle 52 includes a plurality of tabs that are welded to the housing 18. In another embodiment, the baffle 52 is directly welded to the housing 18. In yet another embodiment, the baffle 52 is releasably connected to the housing 18 by way of bolts or other releasable mechanical connectors. In a further embodiment, the baffle 52 is integrally formed with the housing 18. The baffle 52 is configured to assist in reducing or restraining the amount of snow that is re-circulated within the housing 12 by limiting the amount of snow leaving the augers 34 of the second stage assembly 40 centripetally, wherein the baffle 52 then directs the snow toward the impeller 44 of the third stage assembly 42 to be expelled via the chute 16. The baffle 52 can be made by any resilient material such as steel, aluminum, or any other type of metal or hard plastic that can withstand the stresses and temperature conditions of the snow thrower 10.

The longitudinal drive shaft 26 is powered by the power supply 12 such that the longitudinal drive shaft rotates between about 50 to about 1500 RPM. In an embodiment, the impeller 44 of the third stage assembly 42 and the augers 34 of the second stage assembly 42 are operatively connected to the longitudinal drive shaft 26 such that the impeller 44 and the second stage assembly augers 34 rotate at substantially the same rotational velocity as the longitudinal drive shaft 26. The rotational power of the longitudinal drive shaft 26 is transferred to the lateral drive shaft 30 by way of the gear assembly 28. In the illustrated exemplary embodiment, the gear assembly 28 is configured to transfer rotational power from the longitudinal drive shaft 26 to the lateral drive shaft 30, whereby the lateral drive shaft 30 can rotate at the same rotational velocity as the longitudinal drive shaft 26, a slower rotational velocity relative to the longitudinal drive shaft 26, or a faster rotational velocity relative to the longitudinal drive shaft 26. In the exemplary embodiment illustrated in FIGS. 5A-5B, the augers 34 of the first stage assembly 32 will rotate at the same rotational velocity as the lateral drive shaft 30. As the augers 34 of the first stage assembly 32 rotate about a lateral rotational axis, these augers 34 break up the accumulated snow and ice and push this loosened snow axially toward the second stage assembly 40. The upstream augers 34 of the second stage assembly 40 positioned forward of the gear assembly 28 also are configured to assist in breaking up the accumulated snow and ice. All of the augers 34 of the second stage assembly 40 are also configured to push the loosened snow as well as the snow from the first stage assembly 40 axially. The first stage assembly 32 pushes the loosened snow axially in a lateral manner, whereas the second stage assembly 40 pushes the loosened snow axially in a longitudinal manner toward the third stage assembly 42. As the loosened snow is pushed into the third stage assembly 42, the impeller 44 rotates at a sufficient rotational velocity to push or throw the snow in a radially outward manner through the chute 16 and away from the snow thrower 10.

In an embodiment, the augers 34 of the first stage assembly 32 are configured to rotate at substantially the same rotational velocity as the augers 34 of the second stage assembly 40 and the impeller 44 of the third stage assembly 42. In another embodiment, the augers 34 of the first stage assembly 32 are configured to rotate at a different rotational velocity than the augers 34 of the second stage assembly 40 and the impeller 44 of the third stage assembly 42. In yet another embodiment, the augers 34 of the second stage assembly 40 are configured to rotate at a different angular velocity than the impeller 44 of the third stage assembly 42.

Rotation of the augers 34 of the first stage assembly 32 causes accumulated snow and ice to break up and be and easily moveable or transferrable. This rotation of the augers 34 draws the snow and ice into the housing 18, thereby reducing the amount of forward or longitudinal thrust that must be applied to the snow thrower 10 by the operator. The downward motion of the leading edge of the augers 34 of the first stage assembly 32 tend to drive the snow thrower 10 upwardly as it contacts compacted or accumulated snow and/or other material. The longitudinal orientation of the augers 34 of the second stage assembly 40 tend to reduce this upward movement of the first stage assembly 32 by pulling the accumulated snow into the housing 18, thereby providing forward momentum for the snow thrower 10. The flights 36 of the augers 34 of the second stage assembly 32 provide a force that balances the upward and downward forces on the snow thrower 10.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A multi-stage snow thrower comprising:

a power supply;

a housing operatively connected to said power supply;

a longitudinal drive shaft operatively connected to said power supply, wherein said power supply selectively rotates said longitudinal drive shaft;

a lateral drive shaft operatively connected to said longitudinal drive shaft, wherein said lateral drive shaft is oriented transverse relative to said longitudinal drive shaft, and rotation of said longitudinal drive shaft causes rotation of said lateral drive shaft;

a first stage assembly operatively connected to said lateral drive shaft for moving snow laterally within said housing;

a second stage assembly operatively connected to said longitudinal drive shaft for receiving said snow from said first stage assembly and moving said snow longitudinally within said housing; and a third stage assembly operatively connected to said longitudinal drive shaft adjacent to said second stage assembly for receiving said snow from said second stage assembly and moving said snow radially to discharge said snow from said housing.

2. The multi-stage snow thrower of claim 1, wherein said first stage assembly includes at least two augers operatively connected to said lateral drive shaft, and rotation of said lateral drive shaft causes said at least two augers to rotate about said lateral drive shaft to move said snow axially along said lateral drive shaft.

3. The multi-stage snow thrower of claim 2, wherein said first stage assembly includes two opposing augers operatively connected to said lateral drive shaft, and rotation of said lateral drive shaft causes each of said augers to rotate about said lateral drive shaft and move said snow axially toward the other of said augers along said lateral drive shaft.

4. The multi-stage snow thrower of claim 1, wherein said second stage assembly includes at least one auger operatively connected to said longitudinal drive shaft, and rotation of said longitudinal drive shaft causes said at least one auger to rotate about said longitudinal drive shaft to move said snow axially along said lateral drive shaft.

5. The multi-stage snow thrower of claim 1, wherein said second stage assembly moves snow in a direction transverse relative to a direction said first stage assembly moves snow.

6. The multi-stage snow thrower of claim 1, wherein said third stage assembly includes an impeller operatively connected to said longitudinal drive shaft, and rotation of said longitudinal drive shaft causes said impeller to rotate about said longitudinal drive shaft to move said snow radially away from said longitudinal drive shaft into said chute.

7. The multi-stage snow thrower of claim 1 further comprising a gear assembly operatively connected to said longitudinal drive shaft and said lateral drive shaft, wherein rotation of said longitudinal drive shaft is transferrable to said lateral drive shaft within said gear assembly.

8. The multi-stage snow thrower of claim 7, wherein said longitudinal drive shaft includes a first worm gear formed into a portion of an outer surface thereof and said lateral drive shaft includes a second worm gear formed into a portion of an outer surface thereof, said first and second worm gears being in meshed engagement within said gear assembly.

9. A multi-stage snow thrower comprising:

a housing;

a first stage assembly positioned within said housing, wherein said first stage assembly moves said snow in a lateral direction within said housing;

a second stage assembly at least partially positioned within said housing, wherein said second stage assembly moves said snow longitudinally within said housing in a direction transverse to said lateral direction;

a third stage assembly positioned within said housing, wherein said third stage assembly moves said snow radially to expel said snow from said housing; and a power supply operatively connected to said housing, wherein said power supply is operatively connected to said first, second, and third stage assemblies for providing rotational power to each of said stage assemblies, wherein rotation of said third stage assembly by said power supply causes rotation of said first stage assembly and said second stage assembly.

10. The multi-stage snow thrower of claim 9, wherein said first stage assembly is operatively connected to a lateral drive shaft that is rotatably attached to opposing side walls of said housing, and said first stage assembly includes at least two augers operatively connected to said lateral drive shaft.

11. The multi-stage snow thrower of claim 10, wherein said second stage assembly is operatively connected to a longitudinal drive shaft, and said second stage assembly includes at least one auger operatively connected to said longitudinal drive shaft, and said longitudinal drive shaft being operatively connected to said lateral drive shaft in a transverse relationship, wherein rotation of said longitudinal drive shaft causes rotation of said lateral drive shaft.

12. The multi-stage snow thrower of claim 11, wherein said gear assembly includes a casing, wherein said longitudinal drive shaft is meshingly engaged with said lateral drive shaft within said housing.

13. The multi-stage snow thrower of claim 11, wherein said third stage assembly includes an impeller operatively connected to said longitudinal drive shaft.

14. A multi-stage snow thrower comprising:

a power supply;

a housing;

a first stage assembly laterally oriented and rotatable about a lateral axis within said housing for moving snow laterally within said housing;

a second stage assembly operatively connected to said first stage assembly, said second stage assembly being longitudinally oriented and rotatable about a first longitudinal axis within said housing for receiving said snow from said first stage assembly and moving said snow longitudinally within said housing; and a third stage assembly longitudinally oriented and rotatable about a second longitudinal axis within said housing for receiving said snow from said second stage assembly and moving said snow radially to expel said snow from said housing, said third stage assembly being selectively rotatable by said power supply, wherein rotation of said third stage assembly causes rotation of said second stage assembly and said first stage assembly; and a gear assembly positioned at an intersection between said lateral axis and said second longitudinal axis, wherein rotational power is transferred from said third stage assembly to said first stage assembly within said gear assembly.

15. The multi-stage snow thrower of claim 14, wherein said first stage assembly includes at least two augers operatively connected to a lateral drive shaft defining said lateral axis, and rotation of said lateral drive shaft causes said at least two augers to rotate about said lateral axis to move said snow axially along said lateral axis.

16. The multi-stage snow thrower of claim 15, wherein said first stage assembly includes two augers operatively connected to said lateral drive shaft and each of said two augers positioned adjacent to opposing sides of said gear assembly, and rotation of said lateral drive shaft causes each of said augers to rotate about said lateral axis to move said snow axially along said lateral axis toward the other of said augers.

17. The multi-stage snow thrower of claim 14, wherein said second stage assembly includes at least one auger operatively connected to a longitudinal drive shaft defining said first longitudinal axis, and rotation of said longitudinal drive shaft causes said at least one auger to rotate about said first longitudinal axis to move said snow longitudinally within said housing.

18. The multi-stage snow thrower of claim 17, wherein said third stage assembly includes an impeller operatively connected to said longitudinal drive shaft, said first and second longitudinal axes being colinear, and rotation of said longitudinal drive shaft causes said impeller to rotate about said second longitudinal axis to move said snow radially to expel said snow from said housing.

19. The multi-stage snow thrower of claim 14, wherein said first stage assembly is operatively connected to a lateral drive shaft and said second and third stage assemblies operatively connected to a longitudinal drive shaft, said lateral drive shaft and said longitudinal drive shaft engaging each other within said gear assembly, wherein said longitudinal drive shaft includes a first worm gear formed into a portion of an outer surface thereof and said lateral drive shaft includes a second worm gear formed into a portion of an outer surface thereof, said first and second worm gears being in meshed engagement within said gear assembly for transferring rotational power from said third stage assembly to said first stage assembly.

20. The multi-stage snow thrower of claim 14, wherein said first and second longitudinal axes are parallel.

21. The multi-stage snow thrower of claim 14, wherein said first and second longitudinal axes are colinear.

* * * * *